US006647881B2

(12) United States Patent
Müller et al.

(10) Patent No.: US 6,647,881 B2
(45) Date of Patent: Nov. 18, 2003

(54) PRINTING MACHINE AND ATMOSPHERIC CHANGING DEVICE THEREFOR

(75) Inventors: Rolf Müller, Nussloch (DE); Matthias Niedernhuber, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 89 days.

(21) Appl. No.: 09/859,835

(22) Filed: May 17, 2001

(65) Prior Publication Data

US 2001/0042472 A1 Nov. 22, 2001

(30) Foreign Application Priority Data

May 17, 2000 (DE) ..... 100 23 944

(51) Int. Cl.[7] ..... B41L 35/14
(52) U.S. Cl. ..... 101/424.1; 101/488; 101/216
(58) Field of Search ..... 101/424.1, 488, 101/487, 232, 216

(56) References Cited

U.S. PATENT DOCUMENTS 3,934,112 A * 1/1976 Lakhani ..... 219/216
4,760,790 A * 8/1988 Birkett ..... 101/470
4,787,547 A * 11/1988 Hella et al. ..... 242/615.11
5,477,780 A * 12/1995 Keller ..... 101/137
5,595,118 A * 1/1997 Villaverde et al. ..... 101/424.1
6,135,026 A 10/2000 Kalbantner et al. ..... 101/232
6,293,196 B1 * 9/2001 DeMoore et al. ..... 101/424.1

FOREIGN PATENT DOCUMENTS

| | | |
|---|---|---|
| DE | 4118658 A1 | 1/1992 |
| DE | 19513426 A1 | 10/1996 |
| DE | 19914178 A1 | 10/1999 |
| DE | 19838975 A1 | 3/2000 |
| DE | 19842740 A1 | 3/2000 |
| DE | 19812711 C2 | 4/2000 |

* cited by examiner

*Primary Examiner*—Andrew H. Hirshfeld
*Assistant Examiner*—Anthony H. Nguyen
(74) *Attorney, Agent, or Firm*—Laurence A. Greenberg; Werner H. Stemer; Gregory L. Mayback

(57) ABSTRACT

In a printing machine processing printing material along a processing path, an atmospheric changing device for altering atmospheric conditions in surroundings of the printing material includes a connection module, and a slide-in unit having a module end. The slide-in unit is to be joined to the connection module to form a functional unit. The functional unit is to be slid in an insertion direction into a working position in a printing machine and, in the working position, the functional unit extending transversely with respect to a processing path over printing material running through the processing path. For easy handling of the functional unit, the module end, pointing in the insertion direction, couples with the connection module as the slide-in unit is slid into the working position.

22 Claims, 10 Drawing Sheets

PRINTING MACHINE AND ATMOSPHERIC CHANGING DEVICE THEREFOR

BACKGROUND OF THE INVENTION

Field of the Invention

The invention relates to a printing machine through which printing material runs along a processing path. The printing machine has an apparatus to create specific atmospheric conditions in the surroundings of the printing material and that includes a connection module and a slide-in unit that can be joined to the module to form a functional unit. The slide-in unit can be slid in an insertion direction into a working position in the printing machine and, in the working position, extends transversely with respect to the processing path over the printing material running through the latter.

The atmospheric conditions in the surroundings of the printing material include, in particular, their moisture content, temperature and pressure, and the flow conditions, in particular, at the surface of the printing material. To influence the atmospheric conditions, the prior art items taking the form of, in particular, dryers, blowing and extraction devices, and cooling devices are used. The dryers act on the printing material with IR or UV radiation and/or with hot air, and the cooling devices blow cold air onto the printing material. These items are constituted in the form of slide-in units, of which a respective one is configured for at least one of the aforementioned functions (drying, extraction, blowing, cooling) and is constructed in the form of a housing. To fulfill their functions, these slide-in units are generally inserted into the printing machine over the running path of the printing material and are connected to lines that partly serve to supply the slide-in units with electrical voltage and partly originate from suction and/or blowing nozzles of blowers. The construction of such items as slide-in units takes account of the circumstance that guide surfaces for the printing material are generally provided underneath them, and that these guide surfaces have to be cleaned after a certain operating period of the printing machine. For cleaning, the slide-in units are displaced transversely with respect to the processing direction of the printing material, from their working position inserted into the printing machine, such that after appropriate guards have been opened, the guide surfaces are accessible to be cleaned. To make the displacement possible, the ends of the lines that are connected to the slide-in units have to be detached from the slide-in units. Accordingly, in the case of a printing machine marketed by the applicant under the type designation SM 102, a respective, corresponding slide-in housing is connected to the aforementioned lines through a coupling plate detachably connected to the housing. The coupling plate is provided at an end of the slide-in housing that is associated with the drive side of the printing machine and, in this case, on the underside of the housing, so that the lines, starting from the coupling plate, lead away directly downward and, underneath a machine catwalk, can be routed into a supply cabinet associated with the drive side. After the coupling plate has been detached, the corresponding slide-in unit can then be withdrawn from the printing machine in the direction of the supply cabinet. To achieve the best possible accessibility to the aforementioned guide surfaces over their total extent transversely with respect to the processing direction, the supply cabinet has to be erected with such a lateral spacing from the printing machine that the slide-in unit can be withdrawn sufficiently far from the machine.

SUMMARY OF THE INVENTION

It is accordingly an object of the invention to provide a printing machine that overcomes the hereinafore-mentioned disadvantages of the heretofore-known devices of this general type and that configures the printing machine in an advantageous manner from a point of view of handling the apparatus for creating specific atmospheric conditions in the surroundings of the printing material.

With the foregoing and other objects in view, in a printing machine processing printing material along a processing path, there is provided, in accordance with the invention, an atmospheric changing device for altering atmospheric conditions in surroundings of the printing material, the atmospheric changing device including a connection module, and a slide-in unit having a module end, the slide-in unit to be joined to the connection module to form a functional unit, the functional unit to be slid in an insertion direction into a working position in a printing machine and, in the working position, the functional unit extending transversely with respect to a processing path over printing material running through the processing path, the module end pointing in the insertion direction coupling with the connection module as the slide-in unit is slid into the working position.

With the objects of the invention in view, there is also provided an atmospheric changing device for altering atmospheric conditions in surroundings of printing material processing along a processing path of a printing machine, including a connection module, and a slide-in unit having an end, the slide-in unit to be joined to the connection module to form a functional unit, the functional unit to be slid in an insertion direction into a working position in a printing machine and, in the working position, the functional unit extending transversely with respect to a processing path over printing material running through the processing path, the end pointing in the insertion direction coupling with the connection module as the slide-in unit is slid into the working position.

An end of the slide-in unit pointing in an insertion direction can be coupled to the connection module as the unit is slid into the working position.

In the configuration, it is merely necessary to separate the functional unit at joint faces on the same while displacing the slide-in unit away from the connection module to permit access to regions in the printing machine that, in the working position of the slide-in unit, are blocked by the slide-in unit. All the lines needed for the functioning of the apparatus can be connected to the connection module and do not need to be uncoupled from the apparatus in order to make the aforementioned separation possible.

In accordance with another feature of the invention, the connection module has internal spaces, the slide-in unit has further internal spaces, and at least one of the internal spaces communicates with at least one of the further internal spaces when the connection module and the slide-in unit are coupled together.

In accordance with a further feature of the invention, the slide-in unit defines at least one duct extending transversely with respect to the processing direction. The duct has an air passage opening facing the printing material during operation of the printing machine.

In accordance with an added feature of the invention, there is provided a drive motor, and a flow-producing machine connected to the drive motor. At least one of the internal spaces is connected to the flow-producing machine.

In accordance with an additional feature of the invention, there is provided a compressor. The connection module has at least one union communicating with the compressor. The slide-in unit has a blowing device to be coupled to the at least one union as the slide-in unit is joined to the connection module. The blowing device, during operation of the printing machine, blows air supplied by the compressor in a direction of the printing material when the connection module and the slide-in unit are coupled together.

In accordance with yet another feature of the invention, the slide-in unit has a radiator oriented toward the printing material. The radiator, during operation of the printing machine and when the functional unit is in a joined state, radiates the printing material with at least one of infrared electromagnetic waves and ultraviolet electromagnetic waves.

In accordance with yet a further feature of the invention, the connection module and the slide-in unit each have electrical connections to be coupled together for supplying the slide-in unit with electrical voltage when the connection module and the slide-in unit are joined to form the functional unit.

In accordance with yet an added feature of the invention, the connection module has a flow device for producing blown air to purge an environment around the radiator when the functional unit has been joined. Preferably, the flow device is motor-operated.

In accordance with yet an additional feature of the invention, there is provided a blower. At least one of the internal spaces in the connection module is connected to the blower, and an air volume flow produced by the blower, during operation of the printing machine and in a joined state of the functional unit, flows through the air passage opening in a direction of the printing material.

In accordance with again another feature of the invention, the blower is disposed immediately upstream of the connection module with respect to an air flow direction.

In accordance with again a further feature of the invention, the connection module has a blower union, and the blower is connected to the connection module through the blower union.

In accordance with again an added feature of the invention, there is provided a heating module and the air volume flow passes through the heating module prior to emerging from the air passage opening.

In accordance with again an additional feature of the invention, there are provided fixed-position, mutually opposite guide profiles removably connected to the slide-in unit for holding the slide-in unit therebetween. The guide profiles form-fittingly guide the slide-in unit into the printing machine.

In accordance with still another feature of the invention, the connection module is fixed to the guide profiles.

In accordance with still a further feature of the invention, the slide-in unit has an end opposite the module end and a tensioner for clamping the slide-in unit to the connection module. The tensioner is disposed at the end opposite the module end.

In accordance with still an added feature of the invention, the tensioner has a fixed-position clamping face facing the connection module, and a pivotable clamping clip to be pivoted on the slide-in unit and, when pivoted in a tensioning direction, engages the clamping face and, supported on the clamping face, presses the slide-in unit against the connection module.

In accordance with still an additional feature of the invention, the pivotable clamping clip engages behind the clamping face.

In accordance with another feature of the invention, there is provided a clamping bolt disposed on at least one of the guide profiles and bearing the clamping face.

In accordance with a further feature of the invention, there is provided a handle for displacing the slide-in unit, the handle fixed to the clamping clip.

In accordance with an added feature of the invention, there is provided a releasable lock preventing the slide-in unit from being pulled completely out of the guide profiles when in a locked state.

In accordance with an additional feature of the invention, the printing machine has a drive side and the connection module is disposed on the drive side of the printing machine.

In the case of a preferred placing of the connection module on the drive side of the printing machine, the slide-in unit can be withdrawn from the operating position from the operating side and can, therefore, also be slid into the operating position. On the drive side of the printing machine there is generally sufficient space available to withdraw the slide-in unit from the printing machine without hindrance. The configuration also facilitates, in particular, maintenance and repair work on the slide-in unit, such as, in the case of an IR or UV dryer, the cleaning or the replacement of its radiators.

Furthermore, supply cabinets disposed on the drive side can be moved close to the printing machine in a space-saving manner without impeding the handling of the apparatus.

In accordance with a concomitant feature of the invention, the slide-in unit is coupled to the connection module at the module end when the slide-in unit is in a working position.

Other features that are considered as characteristic for the invention are set forth in the appended claims.

Although the invention is illustrated and described herein as embodied in a printing machine, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
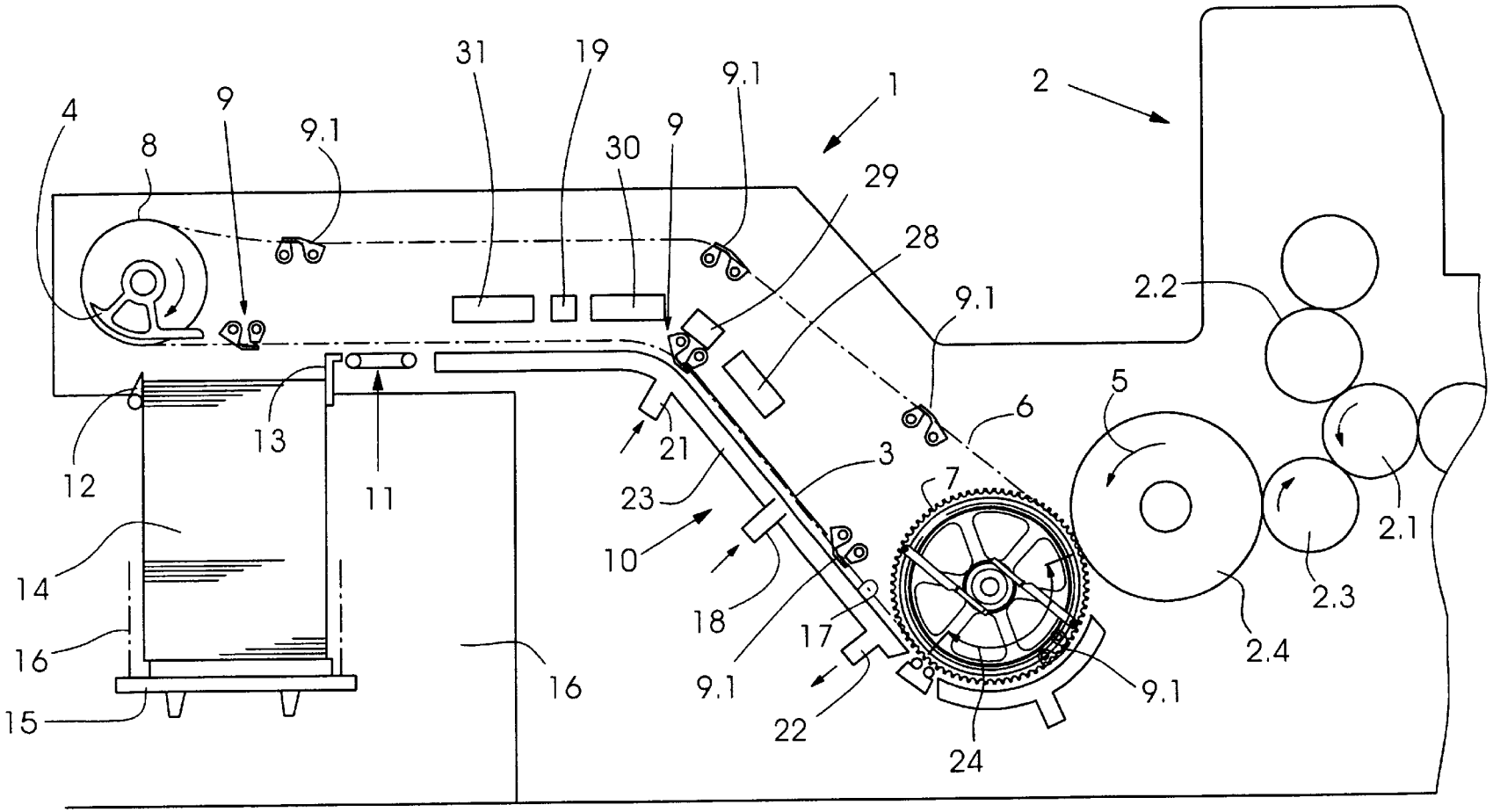
FIG. 1 is a diagrammatic, fragmentary, cross-sectional view of a sheet-processing printing machine having a delivery.

In the case of sheet-processing printing machines, functional units for creating specific atmospheric conditions in the surroundings of a printing material running through a printing machine are used, in particular, in the delivery of such a printing machine. In the following text, by way of example, reference is made to such a case.

In all the figures of the drawing, sub-features and integral parts that correspond to one another bear the same reference symbol in each case.

Referring now to the figures of the drawings in detail and first, particularly to FIG. 1 thereof, there is shown a delivery 1 follows a last processing station in the printing machine in the processing direction. Such a processing station may be a printing unit or a post-treatment unit, such as a varnishing unit. In the present example, the last processing station is a printing unit 2 operating on the offset process and having an impression cylinder 2.1. The impression cylinder 2.1 carries a respective sheet 3 in a processing direction indicated by the direction-of-rotation arrow 5 through a press nip between the impression cylinder 2.1 and a blanket cylinder 2.2 cooperating with the impression cylinder 2.1. The sheet 3 is then transferred to a row of grippers on a single-turn transfer drum 2.3 while opening a row of grippers disposed on the impression cylinder 2.1 and provided to grip the sheet 3 at a gripper edge on the leading end of the sheet 3. A corresponding transfer of the sheet 3 then takes place from the single-turn transfer drum 2.3 to a further half-turn transfer drum 2.4, which finally transfers the sheet 3 to the delivery 1. The delivery 1 includes two endless conveyor chains 6, of which, during operation, a respective one circulates along a closed chain path in the vicinity of a respective side wall of the delivery 1. A respective conveyor chain 6 wraps around each of two synchronously driven drive sprockets 7, whose axes of rotation are aligned with each other, and are respectively led over a deflection sprocket 8 located opposite the drive sprockets 7 and downstream with respect to the processing direction. As such, a respective one of the conveyor chains 6 runs through a closed chain path. Between the two conveyor chains 6 there extend gripper bars 9, borne by the latter, with grippers 9.1, which pass through gaps between the grippers disposed on the transfer drum 2.4 and, in so doing, pick up a respective sheet 3 by gripping the aforementioned gripper edge at the leading end of the sheet 3, immediately before the grippers disposed on the transfer drum 2.4 are opened. The grippers 9.1 transport the sheet 3 over a sheet guide apparatus 10 to a braking station 11 and open after the transfer of the sheet 3 to the braking station 11 has taken place. In the braking station 11, the sheets 3 are braked to a deposition speed that is reduced with respect to the processing speed. After reaching the deposition speed, the sheets 3 are finally released, so that a respective, now-retarded sheet 3 finally encounters leading-edge stops 12. The sheet 3, while being aligned with the leading-edge stops 12 and with trailing-edge stops 13 opposite the leading-edge stops 12, together with preceding and/or following sheets 3 forms a stack 14, which can be lowered by a lifting mechanism to the extent to which the stack 14 grows. Of the lifting mechanism, only a platform 15 carrying the stack 14 and lifting chains 16, indicated by a dash-dotted line, carrying the platform 15 are reproduced in FIG. 1.

Along their paths between the drive sprockets 7, on the one hand, and the deflection sprockets 8, on the other hand, the conveyor chains 6 are guided by non-illustrated chain guide rails that determine the chain paths of the chain runs. The sheets 3 are transported by the chain run that mainly lies at the bottom in FIG. 1 along a conveying path. The conveying path, starting from the location of the transfer of the sheets 3 from the transfer drum 2.4 to the delivery 1, extends as far as a location at which a control cam 4 disposed in the area of one of the deflection sprockets 8 operates a non-illustrated roller lever. The roller lever is operatively connected to the grippers 9.1 and opens the grippers 9.1, which are closed under spring tension, thus releasing the sheets 3. That section of the chain path through which the chain run mainly located at the bottom runs follows a sheet guide surface 17 that faces the chain run and is formed on the sheet guide apparatus 10. A supporting air cushion is preferably formed during operation between the sheet guide face 17 and the sheet 3 respectively led away over it. As such, the sheet guide apparatus 10 is equipped with blown-air nozzles that open into the sheet guide surface 17 and of which only one is reproduced in FIG. 1 as a representative for all of them. The blown-air nozzle is symbolically represented in the form of the nozzle 18.

To prevent mutual sticking of the printed sheets in the stack 14, a powdering apparatus 19, inter alia, is provided on the path of the sheets 3 from the drive sprockets 7 to the braking station 11.

For the case of drying the sheets 3 under the action of heat, to avoid excessive heating of the sheet guide surface 17, a coolant circuit is integrated into the sheet guide apparatus 10. The coolant circuit is indicated symbolically in FIG. 1 by an inlet nozzle 21 and an outlet nozzle 22 on a coolant trough 23 associated with the sheet guide surface 17.

In the present example, the aforementioned delivery path has a horizontal section, a section upstream of the latter and rising toward the horizontal section, and a sheet deflection region 24 placed upstream of the latter section.

Figure 2:
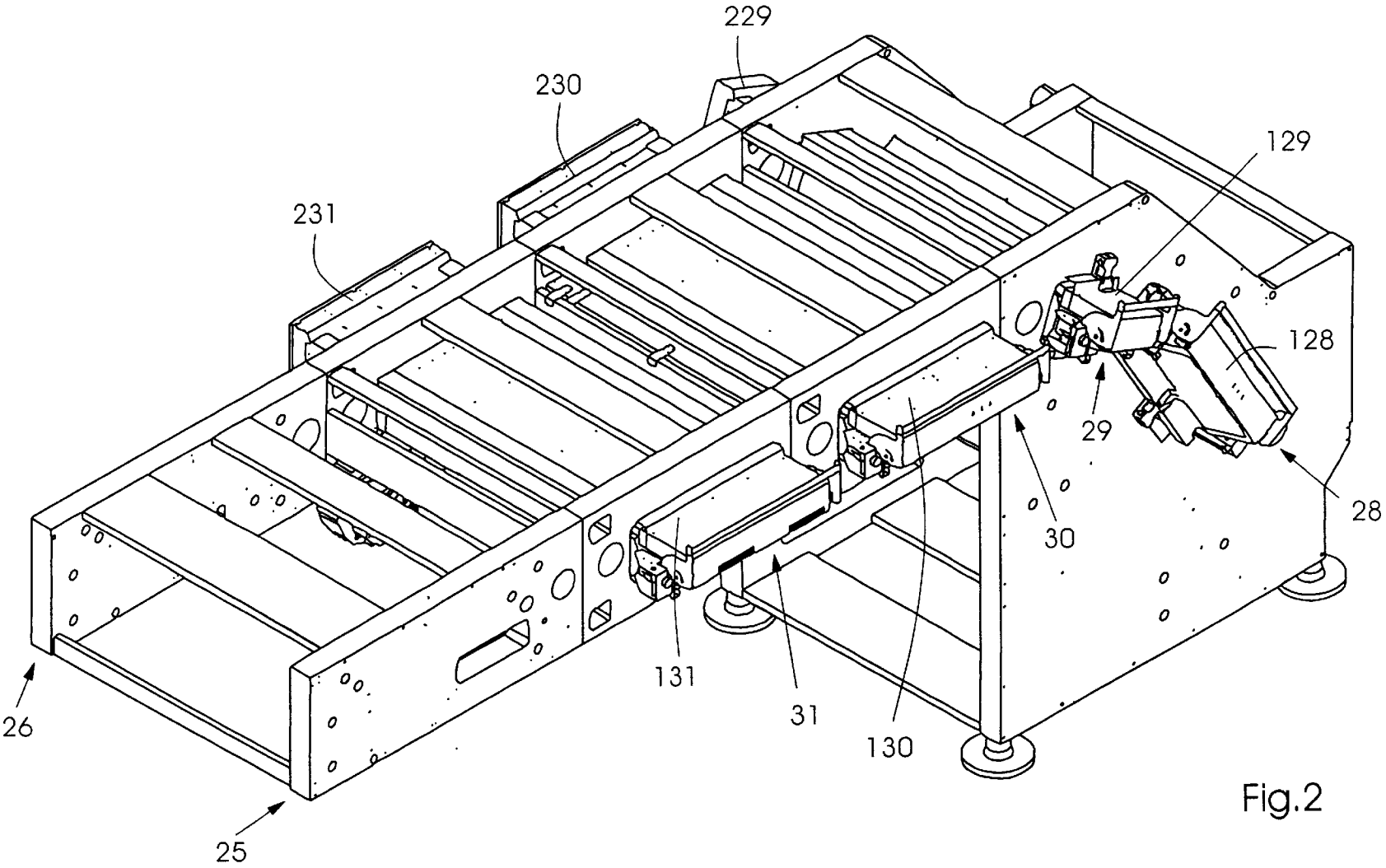
FIG. 2 is a perspective view of an operating side of a machine frame of the delivery of FIG. 1 with functional units placed therein according to the invention.
Figure 3:
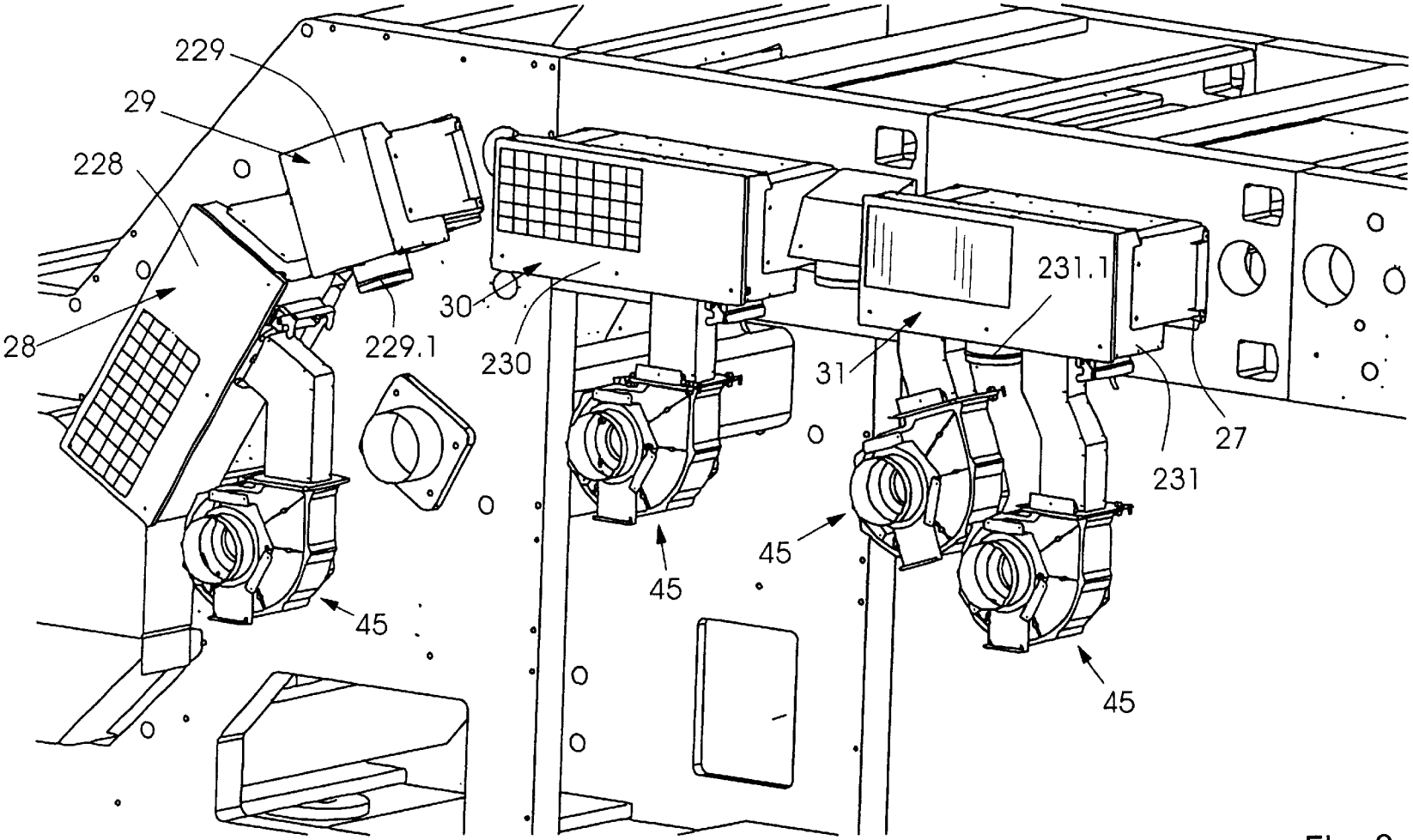
FIG. 3 is a fragmentary, perspective view of the machine frame according to FIG. 2 from a drive side of the printing machine.

FIG. 2 reproduces an example of an unclad machine frame of the delivery 1, specifically in a representation in which the operating side of the printing machine faces the viewer. Provided in the side walls 25, 26 of the machine frame are mutually aligned cutouts 27 (see FIG. 3). In each of the cutouts 27 is disposed one of the functional units 28, 29, 30, and 31, illustrated schematically in FIG. 1. The functional units 28 to 31 each include a slide-in unit 128, 129, 130, and 131 and, as can be seen, in particular, in FIG. 3 which presents the drive side of the printing machine, a respective connection module 228, 229, 230, and 231. In FIGS. 2 and 3, a respective slide-in unit 128 to 131 is located in its working position, is coupled respectively to an associated one of the connection modules 228 to 231, and extends transversely with respect to the processing path over the sheet 3 running through the latter. One section of the processing path is represented in FIG. 1 in the form of a projection, which substantially coincides with the course that can be seen there of the lower runs of the conveyor chains.

In a preferred refinement according to FIGS. 1 to 3, the functional units 28 to 31 fulfill different functions. The functional unit 28 associated with the rising section of the conveying path acts on the sheets 3 with IR radiation and with hot air.

Figure 4:
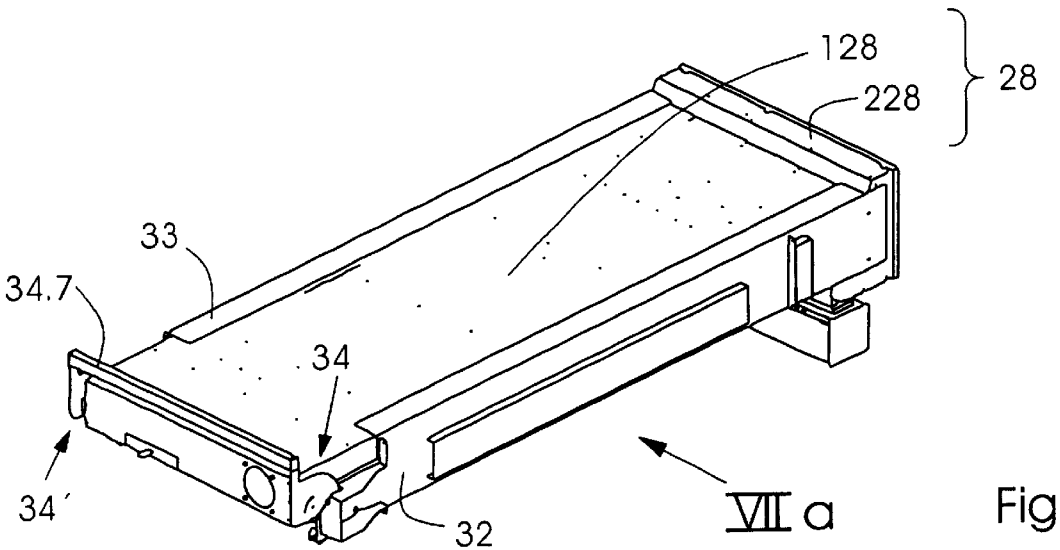
FIG. 4 is a perspective view of one of the functional units of FIG. 2 and guide profiles accommodating the functional unit.

FIG. 4 illustrates the functional unit 28, including guide profiles 32 and 33 bearing the functional unit 28, in an installed position.

The mutually opposite guide profiles 32 and 33 have a substantially U-shaped cross section and, as can be seen, in particular, from the exemplary embodiments according to FIGS. 5, 5*a*, 6, and 6*a*, are provided with fittings 32.1, 32.2, and 33.1, 33.2, on which lugs 32.1', 32.1", 32.2', 32.2", and 33.1', 33.1", 33.2', 33.2" are formed, which can be screwed to a corresponding one of the side walls 25 and 26, on their outer side. As such, the guide profiles 32 and 33 are first inserted into the cutouts 27 in a tilted attitude and, to be screwed to the side walls 25 and 26, are tilted back into the installed position.

Between the guide profiles 32 and 33 so mounted, a respective slide-in unit 128 to 131 can then be inserted in the direction of its working position into the delivery 1, the guide profiles 32 and 33 engaging around the respective slide-in unit 128 to 131 in a form-fitting manner.

While a respective slide-in unit 128 to 131 can be moved into its working position, and can be removed from the working position by displacing it along the guide profiles 32, 33, the respective connection module 228 to 231 remains disposed in a fixed position. In a preferred configuration, as indicated in FIG. 4, a respective one of the connection modules 228 to 231 is fixed to the guide profiles 32 and 33. In addition, the connection modules 228 to 231 are preferably disposed on the drive side of the printing machine.

Figure 7A:
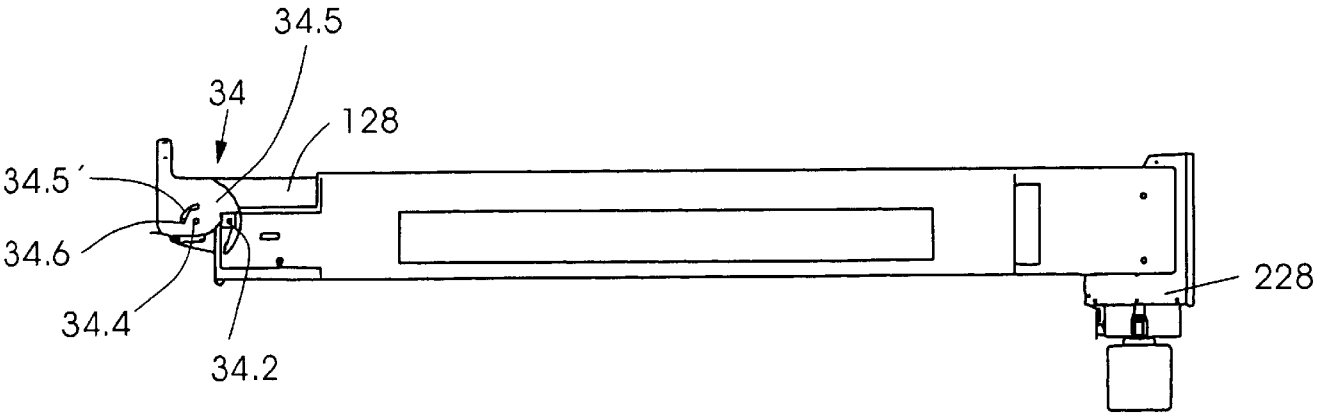
FIG. 7*a* is a side elevational view of the functional unit shown in FIG. 4 in a direction of arrow VIIa.
Figure 7:
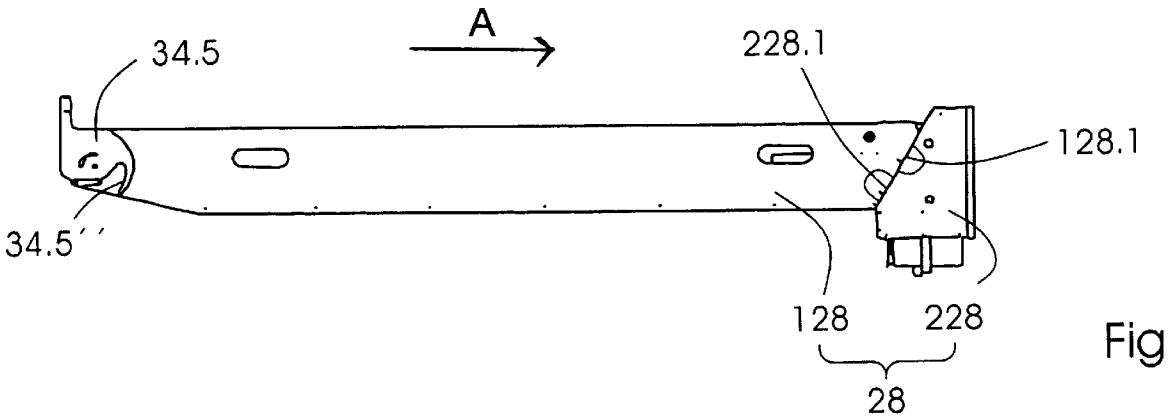
FIG. 7 is a side elevational view of one of the functional units of FIG. 2.

FIG. 7 shows the relative position of one of the slide-in units 128 to 131 with respect to one of the connection modules 228 to 231. With respective connection modules 228 to 231, one of the slide-in units 128 to 131 coupled thereto forms one of the functional units 28 to 31. The slide-in unit 128 is coupled to the connection module 228 by displacing the slide-in unit 128 in the direction of the arrow A indicated in FIG. 7 until it comes into contact with the connection module 228. In the overall view of FIGS. 2 and 4, the direction is the insertion direction, in which a respective one of the slide-in units 128 to 131 can be slid into the printing machine into its working position, so that an end of the respective slide-in unit 128 to 131 pointing in the insertion direction can be coupled to an associated one of the connection modules 228 to 231 as the respective slide-in unit is slid into the working position.

In a preferred configuration, the slide-in units 128 to 131, when in their working position, are coupled to the respectively associated one of the connection modules 228 to 231 at respectively one end of the slide-in units 128 to 131 pointing in the insertion direction.

As indicated in FIG. 7 for functional unit 28, the end of the slide-in unit 128 that points in the insertion direction forms a first joint face 128.1, and the connection module 228 forms a second joint face 228.1, corresponding to the first joint face 128.1. When a slide-in unit 128 is coupled to the connection module 228, these joint faces are in mutually sealing contact. It is preferable for the end of the slide-in unit 128 that points in the insertion direction, or the side of the connection module 228 that is opposite the end, to be covered with a resilient interlayer that forms one of the aforementioned joint faces.

A respective one of the slide-in units 128 to 131 can be locked in the printing machine in its working position which can be seen in FIG. 2. As can be gathered in particular from FIG. 4, at an end pointing in the direction opposite to the insertion direction (see arrow A in FIG. 7) of a respective one of the slide-in units 128 to 131, a tensioner 34 is provided. The respective slide-in unit 128 to 131 can be clamped by the tensioner 34 to the respectively associated connection module 228 to 231, which for its part is fixed in position.

Figure 5:
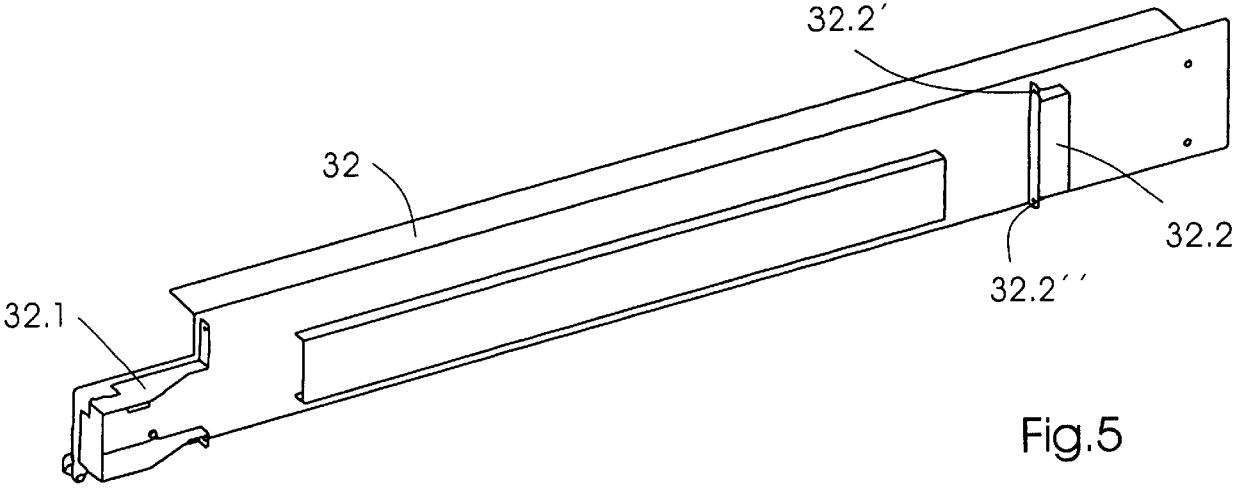
FIG. 5 is a perspective view one of the guide profiles of FIG. 4.
Figure 5A:
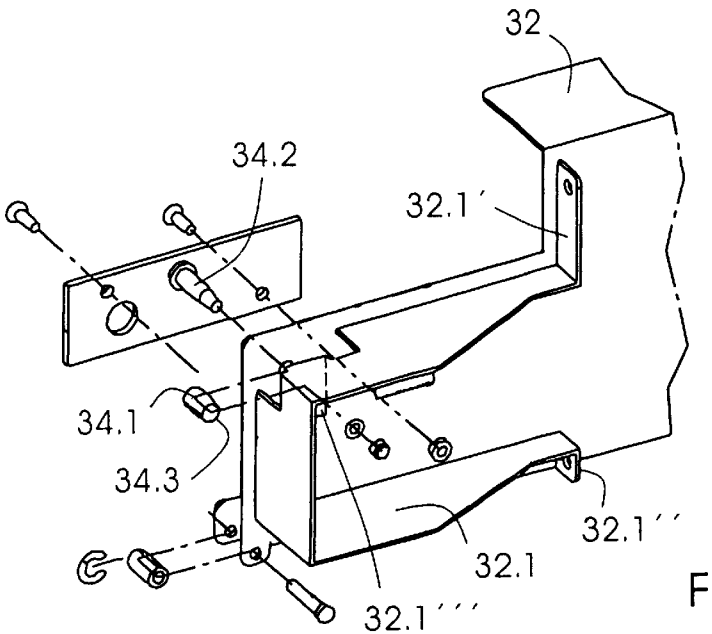
FIG. 5*a* is an enlarged, fragmentary, partly-exploded perspective view of a detail of FIG. 5.

The tensioner 34, which is explained below using the example of the functional unit 28 according to FIG. 4 includes a fixed-position clamping face that faces the connection module 228 and, as explained below, can be seen in particular from FIG. 5*a*. As can be understood from FIG. 5*a*, on one side, on a wall of the guide profile 32 that is vertical in the installed position and, on the other side, in a bent-over portion 32.1'" of the fitting 32.1 that is parallel to the wall and is disposed at a distance therefrom, a clamping bolt 34.2 is accommodated that bridges over the distance and bears a sleeve 34.1 that is matched to the distance. The circumferential face of the sleeve 34.1 forms a clamping face 34.3.

As can be seen in particular from FIG. 7*a*, the tensioner 34 further includes a clamping clip 34.5 that is disposed such that it can be pivoted about an axis 34.4 on the respective one of the slide-in units 128 to 131, here on the slide-in unit 128. When the slide-in unit 128 is inserted into the guide profiles 32, 33, the axis 34.4 runs parallel to the aforementioned clamping bolt 34.2 and, at the same time, is substantially at the same level as the clamping bolt 34.2 and, in the working position of the slide-in unit 128, is spaced apart from the clamping bolt 34.2 in the direction counter to the insertion direction (see arrow A in FIG. 7). The clamping clip 34.5 has a slotted guide 34.5' that is concentric with the axis 34.4 and in which a stop pin 34.6 fixed to the slide-in unit 128 engages. In addition, a clamping cam 34.5" (see FIG. 7) that faces the axis 34.4 is formed on the clamping clip 34.5. The contour of the clamping cam 34.5" approximately constitutes a spiral wound around the axis 34.4. The clamping cam 34.5" engages behind the clamping face 34.3 in the course of a pivoting movement of the clamping clip 34.5 that is carried out in a tensioning direction (in a clockwise direction in FIG. 7*a*). The clamping face 34.3 is formed on the sleeve 34.1 borne by the clamping bolt 34.2. See FIG. 5*a*.

After adequate pivoting of the clamping clip 34.5 in the tensioning direction, the clamping cam 34.5" comes into engagement with the clamping face 34.3, and the slide-in unit is pressed against the connection module 228 due to the illustrated contour of the clamping cam 34.5", the latter being supported on the clamping face 34.3.

The tensioner 34 is disposed on a side of the slide-in unit 128 associated with the guide profile 32. A further tensioner 34', made of parts that, in some cases, are formed in a mirror image of the tensioner 34, is disposed on that side of the slide-in unit 128 that is associated with the guide profile 33. Fixed to a respective clamping clip 34.5 of the two tensioners 34, 34' is a handle 34.7 for displacing the slide-in unit 128. In addition, the handle 34.7 is used to pivot the clamping clips 34.5 of the two tensioners 34, 34'.

The slide-in units 128 to 131 can be displaced out of their working position, in particular, into a park position defined by a respective lock, in which position the slide-in units 128 to 131 are largely withdrawn from the guide profiles 32, 33 and in which position the lock prevents further withdrawal.

Figure 6:
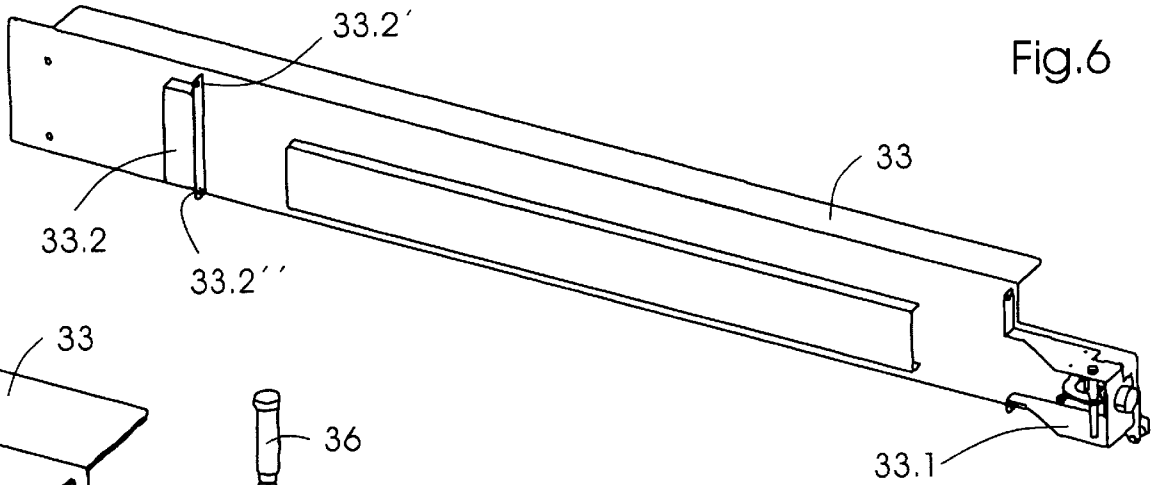
FIG. 6 is a perspective view of another one of the guide profiles of FIG. 4.
Figure 6A:
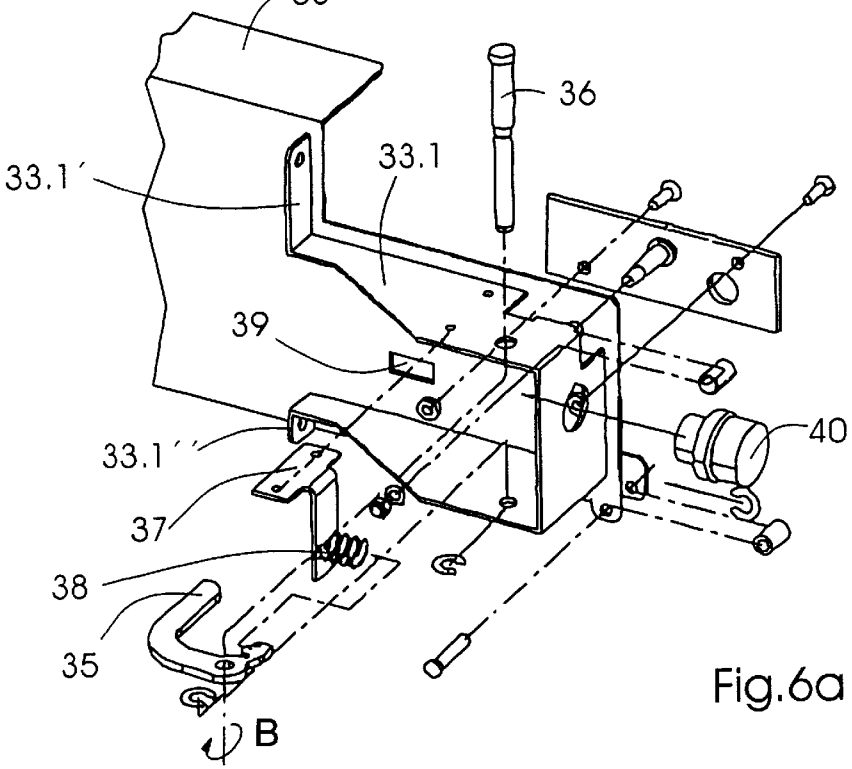
FIG. 6*a* is an enlarged, fragmentary, partly-exploded perspective view of a detail of FIG. 6.

According to a configuration illustrated in FIG. 6*a*, the lock includes a bolt 35 that is borne by a shaft 36, fixed to the fitting 33.1, such that it can be pivoted in the horizontal.

Figure 8:
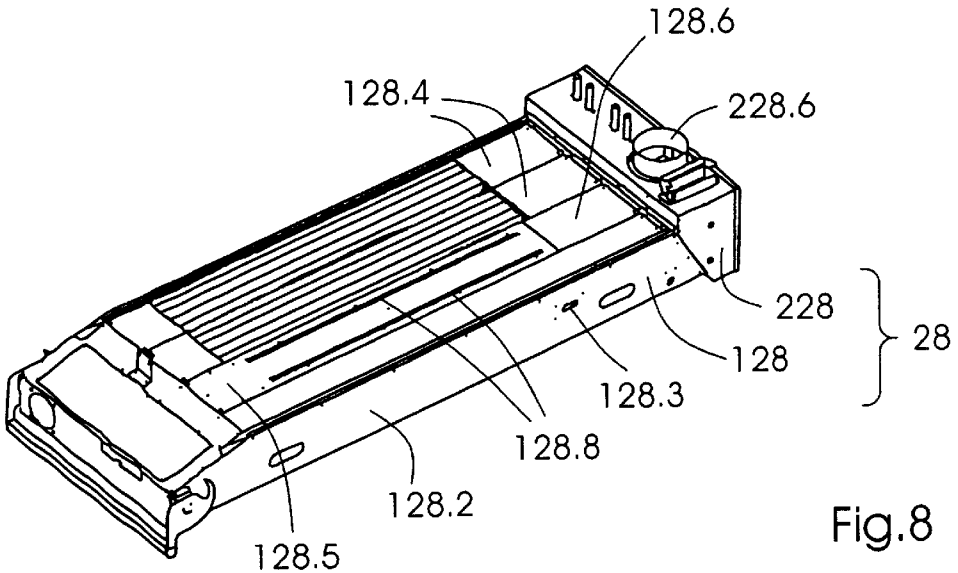
FIG. 8 is a perspective bottom view of the functional unit according to FIG. 7.

Supported on an abutment 37 likewise borne by the fitting 33.1 is a spring 38, that prestresses the bolt 35 in a pivoting direction indicated by the direction-of-rotation arrow B in FIG. 6*a*. Under such prestress acting on the bolt 35, the bolt 35 reaches through a slot 39 in the guide profile 33 and, for example, during the displacement of the slide-in unit 128, presses against a side wall 128.2 sliding along the guide profile 33 (see FIG. 8) and belonging to the slide-in unit 128. Provided in the side wall 128.2 is a cutout 128.3. The cutout 128.3 is placed such that the bolt 35, under the prestress explained, latches into the cutout 128.3 when the slide-in unit 128 is pulled out of its working position and has reached a position in which adequate guidance of the slide-in unit 128 by the guide profiles 32, 33 is still ensured. The slot 39 provided in the guide profile 33 (see FIG. 6*a*) is formed such that the bolt 35 latched into the cutout 128.3 is prevented from pivoting in the direction of the direction-of-rotation arrow B in FIG. 6*a*. Therefore, as the slide-in unit 128 is pulled out of its working position, it reaches a park position in which the bolt 35 has latched into the cutout 128.3 and prevents further withdrawal of the slide-in unit 128.

For fully withdrawing the slide-in unit 128, the lock formed by the bolt 35 can be unlocked. As can be seen from FIG. 6*a*, there is provided on the fitting 33.1 a push-button 40, by which the bolt 35 can be pivoted, counter to the action of the spring 38, in the direction opposite that indicated by the arrow B and can, therefore, be lifted out of the cutout 128.3. See FIG. 8. Corresponding lifting of the bolt 35 otherwise occurs automatically when the slide-in unit 128 is pushed back from its park position in the direction of its working position.

The functional units 28 to 31 to some extent fulfill different functions and, for such a purpose, are equipped individually.

In FIGS. 8 to 11, equipping the functional unit 28 to act on the sheets 3 with IR radiation and hot air is reproduced as an example. The slide-in unit 128 is of modular construction and includes two radiator modules 128.4 and a hot-air module 128.5 that are lined up in a row in the processing direction. A heating module 128.6 is integrated into the hot-air module 128.5. The hot-air module 128.5 is shown as a duct extending transversely with respect to the processing path and having a closed and an open end, the latter forming part of the joint face 128.1 already explained. The duct encloses an internal space 128.7 (see FIG. 9) that, at the joint face 128.1, communicates with a first internal space 228.2 in the connection module 228 (see FIGS. 10 and 11) and, in the example shown, is provided with two air passage openings 128.8 that, during operation, face the sheet 3.

The first internal space 228.2 of the connection module 228 (see FIG. 10) is connected through a union 228.6 to a flow producing machine 42 connected to a drive motor 41. In the present case, it is a blower 45 that produces an air volume flow that flows through the first internal space 228.2 of the connection module 228 and, in the coupled state of the functional unit 28, flows through the heating module 128.6 and then through the internal space 128.7 of the hot-air module 128.5 and the air passage openings 128.8 of the latter in the direction of the sheets 3.

To apply IR radiation to the sheets 3, IR radiators 128.9 in the form of tubes are disposed on a respective outer side of the radiator modules 128.4 located at the bottom in the working position of the slide-in unit 128. In a respective one of these outer sides located at the bottom, non-illustrated outflow openings are provided that communicate with a respective internal space 128.10 of the radiator modules 128.4. In the working position of the slide-in unit 128, these internal spaces 128.10, in turn, communicate with a second internal space 228.3 in the connection module 228. Provided in the second internal space 228.3 is a motor-operated flow-producing machine configuration 228.4 (see FIG. 10), that, through an opening provided with a grill 228.5 on a side of the connection module 228 facing away from the joint face 228.1, draws in ambient air, that then, in the working position of the slide-in unit 128, flows out through the already mentioned non-illustrated outflow openings on the bottom outer side of the respective radiator module 128.4 and purges around a radiator configuration formed by the IR radiators 128.9. Thus cooling the radiator configuration and keeping it free of flying dust such as, in particular, powder from the powdering apparatus 19.

In addition, the functional unit 28 is equipped to convert a boundary-layer flow that faces the functional unit 28 in the working position and exists directly on the sheet 3 into a turbulent flow. At least one further union 228.7, that communicates with a compressor 43, is provided on the connection module 228 (four unions 228.7 are shown in the example according to FIGS. 8 to 11). In the example according to FIGS. 8 to 11, the connection between the unions 228.7 and the compressor 43 is produced through a manifold 44. On its bottom outer side, the slide-in unit 128 is equipped with a blowing apparatus 128.11, which is formed by pipes 128.12 disposed in the vicinity of the IR radiators 128.9. The pipes 128.12, like the tubes forming the IR radiators 128.9, are oriented parallel to one another in the insertion direction of the slide-in unit 128. The pipes 128.12 are closed at their end that faces away from the connection module 228 in the working position. The pipes 128.12 are coupled to the unions 228.7 communicating with the compressor 43 at their other end in the working position. The pipes 128.12 are provided with non-illustrated blower openings on their lower side in the working position, from the blower openings, during operation, compressed air supplied by the compressor 43 is blown in the direction of the sheets 3. The compressed air is under a pressure such that the streams emerging from the blower openings destroy the aforementioned boundary-layer flow.

Figure 9:
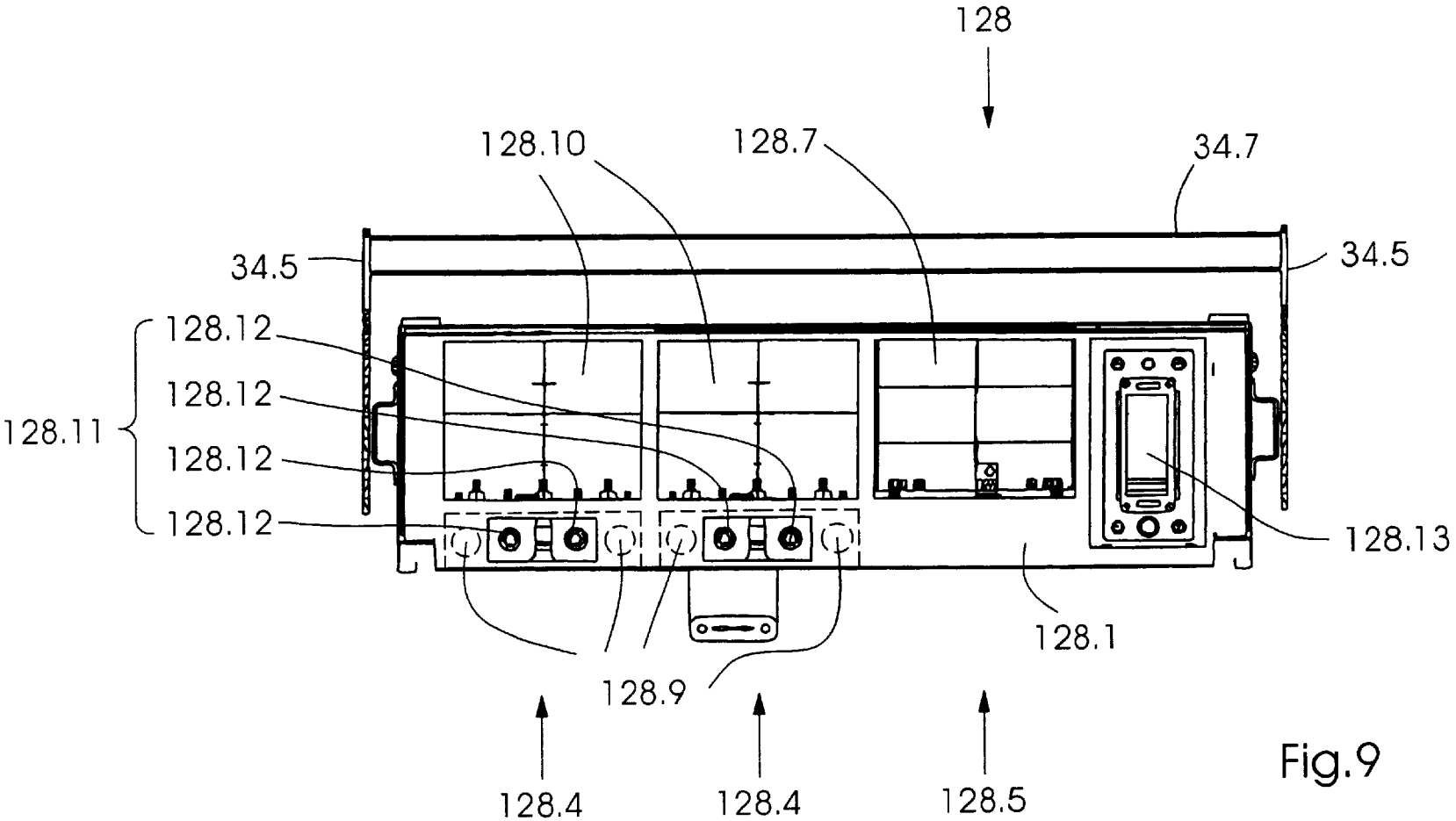
FIG. 9 is a cross-sectional view of one of the slide-in units showing a joint face of one of the functional units of FIG. 2.
Figure 10:
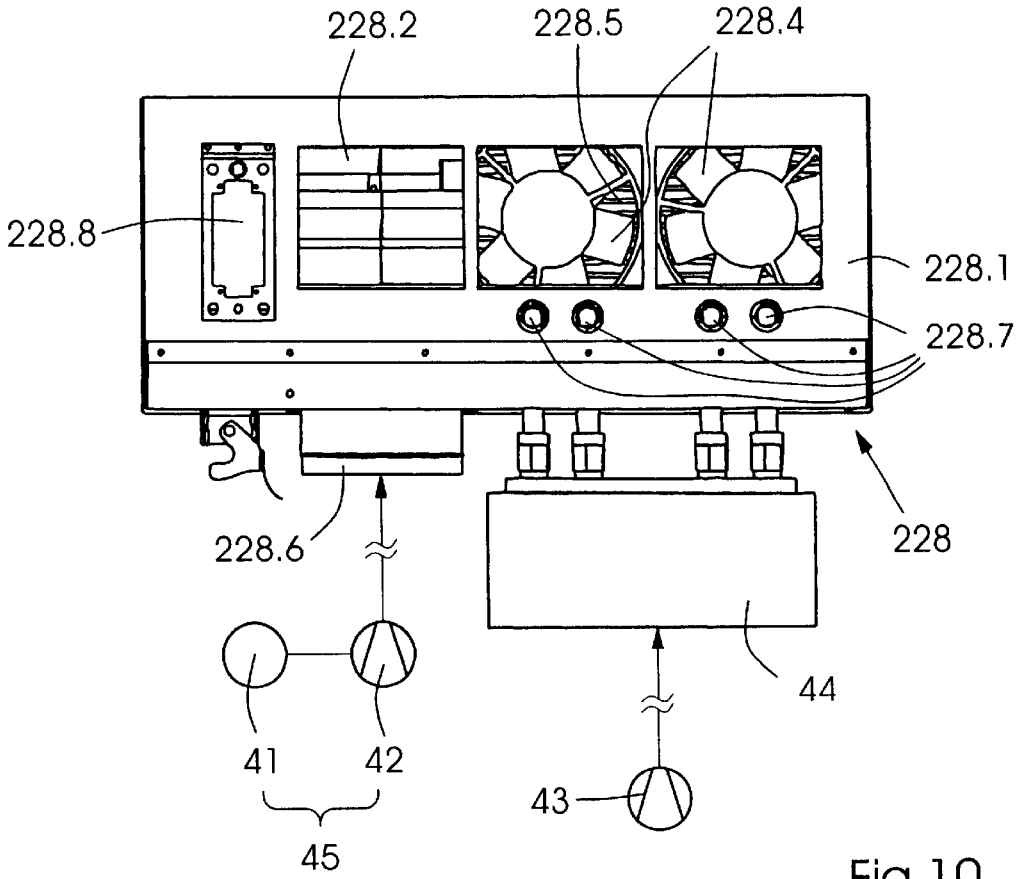
FIG. 10 is an elevational view of the connection module according to FIG. 11 showing a joint face of one of the functional units of FIG. 2 with other components shown in schematic form.
Figure 11:
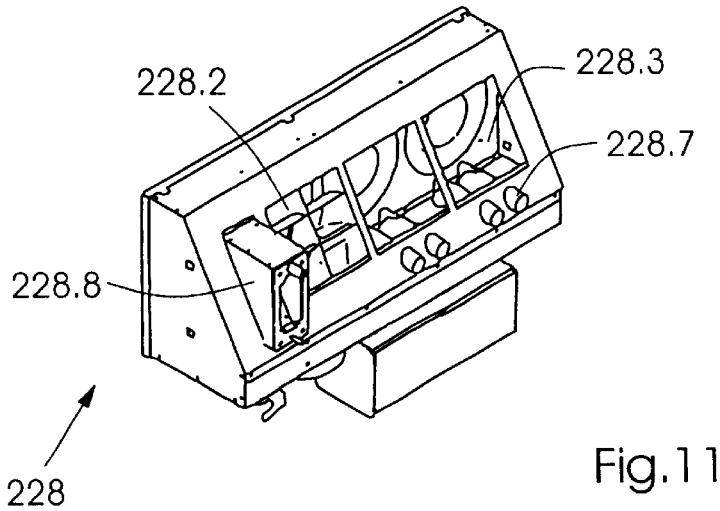
FIG. 11 is a perspective view of a connection module according to the invention.

To supply the slide-in unit 128 with electrical voltage, in particular, to operate the heating module 128.6 and the IR radiators 128.9, the connection module 228 and the slide-in unit 128 are provided with electrical connections 228.8 (see FIGS. 10 and 11) and 128.13 (see FIG. 9). The electrical connections 228.8 can be coupled as the slide-in unit 128 and the connection module 228 are joined to form the functional unit 28.

In the printing machine configuration according to FIGS. 1 to 3, the equipment of the functional unit 28 is also present in the functional unit 30.

Figure 12:
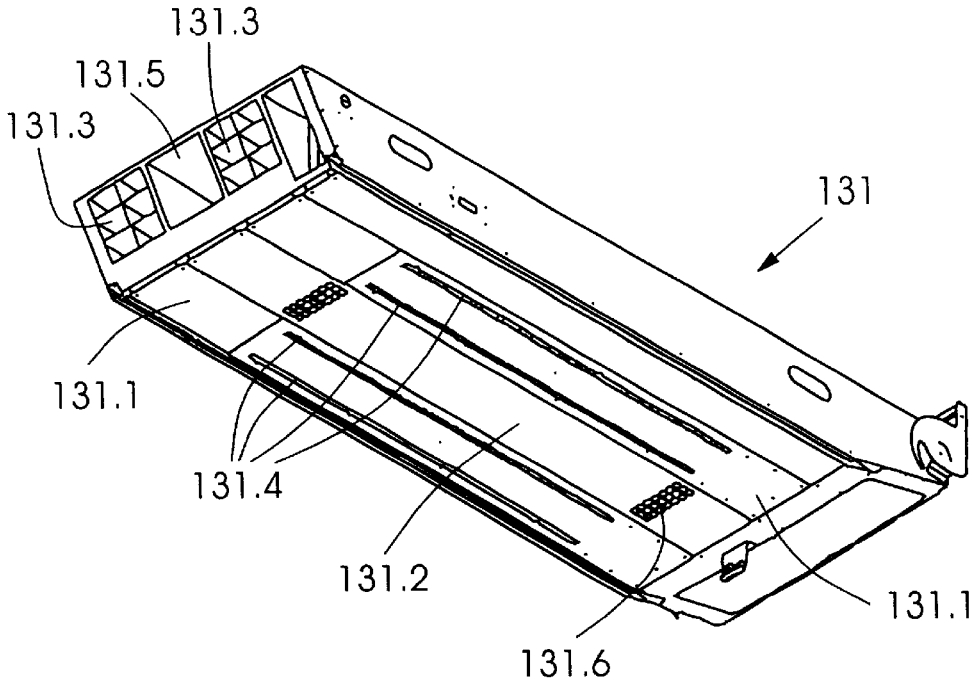
FIG. 12 is a perspective view from below of an alternative embodiment of a functional unit illustrated in FIG. 8.

FIG. 12 illustrates a slide-in unit 131 equipped for the functional unit 31. The slide-in unit has a modular construction, similar to the slide-in unit 128, and includes two cold-air modules 131.1 and an extraction module 131.2.

The associated connection module 231 (see FIGS. 2 and 3) supplies a respective internal space 131.3 in the cold-air modules 131.1 with blown air in a similar way to the functional unit 28, the air emerging from air passage openings 131.4 in the direction of the sheets 3, but without previously passing through a heating module.

To supply the blown air, in a way similar to the functional unit 28 and to the functional unit 30, corresponding internal spaces 131.3 in the cold-air modules 131.1 are connected to a blower 45. The respective connection modules 228, 230, 231 preferably have blowers 45 disposed immediately upstream. In an advantageous configuration, as can be seen in FIG. 3, the blowers 45 are connected to a respective one of the connection modules 228, 230, 231 through a respective blower union provided on the blowers. In addition, a respective one of the internal spaces 128.10 and 131.3 supplied with blown air is respectively assigned an independent blower 45.

An internal space 131.5 of the extraction module 131.2 having extraction openings 131.6 on its underside communicates, through a corresponding internal space in the connection module 231 (see FIGS. 2 and 3) and through a union 231.1 provided on the latter, with a non-illustrated motor-driven flow-producing machine that is connected to the union 231.1 through a suction side of the machine.

The functional unit 29 provided in the instant configuration of the printing machine is equipped, in a manner not specifically illustrated, for extracting and destroying the boundary-layer flow already mentioned. As such, the slide-in unit 129 is provided on its underside with an appropriate extraction opening. An internal space, connected to the extraction opening, in the slide-in unit 129 communicates, in the working position, with an internal space in the connection module 229, the latter internal space, in turn, communicating through a union 229.1 (see FIG. 3), with a suction side of a motor-driven flow-producing machine.

Provided in the region of the extraction opening is a blowing apparatus, already explained, that acts upon the sheets 3 with blown air supplied by a compressor such that the boundary-layer flow on the surface of the sheets 3 is destroyed.

At a location of the functional unit 29 that is provided in the instant configuration, namely in the deflection region between the rising and the horizontal sections of the conveying path of the sheets 3, the momentum of the blown air acting on the sheets 3 also produces the additional advantage that additional lifting of the sheets, promoted by the preceding action of blowing under the sheets, is counteracted by a path imposed by the chain path.

Apart from the functions of the functional units 28 to 31 presented to the extent set forth herein, in a different configuration, UV radiators can act on the sheets 3 as an alternative to the IR radiators acting on the sheets 3.

We claim:

1. In a printing machine processing printing material running in a processing direction along a processing path, an atmospheric changing device for altering atmospheric conditions in surroundings of the printing material, the atmospheric changing device comprising:

a connection module; and slide-in unit having a front end, said front end to be joined to said connection module to form a functional unit, said slide-in unit to be slid into a working position in a printing machine and, in said working position, said slide-in unit extending, with respect to a processing path, transversely across printing material running through the processing path, said front end, upon said slide-in unit sliding into said working position, facing said connection module, said slide-in unit, in said working position, being coupled with said connection module.

2. The printing machine according to claim 1, wherein said connection module has internal spaces;

said slide-in unit has further internal spaces; and at least one of said internal spaces communicates with at least one of said further internal spaces when said connection module and said slide-in unit are coupled together.

3. The printing machine according to claim 2, wherein said slide-in unit defines at least one duct extending transversely with respect to said processing direction, said duct having an air passage opening facing the printing material during operation of the printing machine.

4. The printing machine according to claim 2, including:

a drive motor; and a flow-producing machine connected to said drive motor, at least one of said internal spaces being connected to said flow-producing machine.

5. The printing machine according to claim 2, including a compressor;

said connection module having at least one union communicating with said compressor;

said slide-in unit having a blowing device to be coupled to said at least one union as said slide-in unit is joined to said connection module; and said blowing device, during operation of the printing machine, blowing air supplied by said compressor towards the printing material when said connection module and said slide-in unit are coupled together.

6. The printing machine according to claim 2, wherein:

said slide-in unit has a radiator oriented toward the printing material; and said radiator, during operation of the printing machine and when said functional unit is in a joined state, radiating the printing material with at least one of infrared electromagnetic waves and ultraviolet electromagnetic waves.

7. The printing machine according to claim 1, wherein said connection module and said slide-in unit each have electrical connections to be coupled together for supplying said slide-in unit with electrical voltage when said connection module and said slide-in unit are joined to form said functional unit.

8. The printing machine according to claim 6, wherein said connection module has a flow device for producing blown air to purge an environment around said radiator when said functional unit has been joined.

9. The printing machine according to claim 8, wherein said flow device is motor-operated.

10. The printing machine according to claim 3, including a blower;

at least one of said internal spaces in said connection module connected to said blower; and an air volume flow produced by said blower, during operation of the printing machine and in a joined state of the functional unit, flowing through said air passage opening towards the printing material.

11. The printing machine according to claim 10, wherein said blower is disposed immediately upstream of said connection module with respect to said air volume flow.

12. The printing machine according to claim 10, wherein:

said connect ion module has a blower union; and said blower is connected to said connection module through said blower union.

13. The printing machine according to claim 10, including a heating module, the air volume flow passing through said heating module prior to emerging from said air passage opening.

14. The printing machine according to claim 1, including stationary, mutually opposite guide profiles removably bearing said slide-in unit therebetween, said guide profiles form-fittingly guiding said slide-in unit into the printing machine.

15. The printing machine according to claim 12, wherein said connection module is fixed to said guide profiles.

16. The printing machine according to claim 14, wherein said slide-in unit has an end opposite said front end and a tensioner for clamping said slide-in unit to said connection module, said tensioner disposed at said end opposite said front end.

17. The printing machine according to claim 16, wherein said tensioner has:

a stationary clamping face facing said connection module, and pivotable clamping clip to be pivoted on said slide-in unit and, when pivoted in a tensioning direction, engages said clamping face and, supported on said clamping face, presses said slide-in unit against said connection module.

18. The printing machine according to claim 17, including a clamping bolt disposed on at least one of said guide profiles and bearing said clamping face.

19. The printing machine according to claim 17, including a handle for displacing said slide-in unit, said handle fixed to said clamping clip.

20. The printing machine according to claim 14, including a releasable lock preventing said slide-in unit from being pulled completely out of said guide profiles in a locked state of said lock.

21. The printing machine according to claim 1, wherein the printing machine has a drive side and said connection module is disposed on the drive side of the printing machine.

22. An atmospheric changing device for altering atmospheric conditions in surroundings of printing material processing along a processing path of a printing machine, comprising:

a connection module; and a slide-in unit having a front end, said front end to be joined to said connection module to form a functional unit, said slide-in unit to be slid into a working position in a printing machine and, in said working position, said slide-in unit extending, with respect to a processing path, transversely across printing material running through the processing path, said front end, upon said slide-in unit sliding into said working position, facing said connection module, said slide-in unit, in said working position, being coupled with said connection module.

* * * * *